US006712583B2

(12) United States Patent
Ijima et al.

(10) Patent No.: US 6,712,583 B2
(45) Date of Patent: Mar. 30, 2004

(54) IMPELLER FOR WATER PUMP

(75) Inventors: Toshiro Ijima, Wako (JP); Ryouhei Adachi, Kiryu (JP); Fei Song, Kiryu (JP); Satoshi Maruyama, Kiryu (JP)

(73) Assignees: Honda Giken Kogyo Kabushiki Kaisha, Tokyo (JP); Kabushiki Kaisha Yamada Seisakusho, Kiryu (JP)

( * ) Notice: Subject to any disclaimer, the term of this patent is extended or adjusted under 35 U.S.C. 154(b) by 0 days.

(21) Appl. No.: 10/123,519

(22) Filed: Apr. 17, 2002

(65) Prior Publication Data

US 2002/0187045 A1 Dec. 12, 2002

(30) Foreign Application Priority Data

Apr. 18, 2001 (JP) ..... 2001-120396
Apr. 5, 2002 (JP) ..... 2002-104562

(51) Int. Cl.[7] ..... F04D 29/20
(52) U.S. Cl. ..... 416/185; 416/244 R
(58) Field of Search ..... 416/185, 204 A, 416/204 R, 241 A, 244 R; 415/915

(56) References Cited

U.S. PATENT DOCUMENTS 3,304,796 A * 2/1967 Leege ..... 416/241 A
3,408,944 A * 11/1968 Belonger et al. ..... 416/241 R
5,226,807 A * 7/1993 By et al. ..... 416/244 R
5,730,583 A * 3/1998 Alizadeh ..... 416/189

OTHER PUBLICATIONS

Japanese Patent Application Laid–Open No. 6–129395, May 10, 1994.

Japanese Patent Application Laid–Open No. 9–217699, Aug. 19, 1997.

* cited by examiner

*Primary Examiner*—Edward K. Look
*Assistant Examiner*—Richard A. Edgar
(74) *Attorney, Agent, or Firm*—Lowe Hauptman Gilman & Berner LLP

(57) ABSTRACT

An impeller for a water pump includes an impeller main body composed of a synthetic resin and having a vane member formed around a rotating center portion; and a metal boss in which a circular boss member positioned on the forward side of the rotating center portion and provided with a gradually narrowing portion at the axial end thereof, and a periaxial support boss member positioned on the rearward side of the rotating center portion are consecutively formed in the axial direction, and in which an axial support surface is formed between the circular boss member and periaxial support boss member, the metal boss being insert-fitted into said rotating center portion.

21 Claims, 9 Drawing Sheets

IMPELLER FOR WATER PUMP

BACKGROUND OF THE INVENTION

1. Field of the Invention

The present invention relates to an impeller for a water pump in which a metal boss is insert-fitted into the rotating center portion of the impeller main body, and the area of the rotating center portion facing the impeller main body is fashioned to an adequate thickness, with the metal boss securely fitting into the impeller main body.

2. Description of the Related Art

Metal bosses, which are used in water pumps installed in water-cooled internal combustion engines for vehicles and the like, are insert-fitted into the rotating center portions of impellers composed of synthetic resin. In other words, a metal boss member is fitted by cast-molding when a synthetic resin impeller is molded. Such impellers for water pumps comprising a synthetic resin impeller main body and a metal boss member have been proposed with the metal boss member having various configurations to provide adequate conditions for metal boss inserts.

The boss member disclosed in Japanese Patent Application Laid-open No. H06-129395, for example, has a square column-shaped peripheral member and an undercut (grooved) member, the perimeter member thereof annularly grooved; has rotation stopped in the direction of rotation by the square column-shaped perimeter member, and slipping-off prevented in the axial direction by the undercut member; and good retention in the insert is obtained thereby.

Moreover, the boss member recited in Japanese Patent Application Laid-open No. H09-217699 has a cylindrical body and a polygonal protruding member formed on the center portion in the width direction around the outside of the cylindrical body; has rotation stopped in the direction of rotation by the polygonal protruding member, and slipping-off prevented in the axial direction; and good retention in the insert is obtained thereby.

SUMMARY OF THE INVENTION

The impeller main body for a water pump with a metal boss member insert molded from synthetic resin is configured such that a metal boss member is inserted into the resin, and a detent such as the perimeter of a square column (Japanese Patent Application Laid-open No. H06-129395), a polygonal protruding member (Japanese Patent Application Laid-open No. H09-217699) or the like is formed in the direction of rotation. The impeller main body is fixed to the shaft by the press-fitting of the boss and the shaft.

The stress loads from the boss member on the rotating center portion of the impeller main body molded from synthetic resin is exerted as a result of this press-fitting. For example, the insertion stress load generated when a shaft is press-fitted into a boss, or the plastic deformation of the metal boss member after the shaft has been press-fitted makes it difficult for the resin portion of the rotating center portion of the impeller main body molded from synthetic resin to sufficiently bear residual stress load or another load affecting the resin portion, adversely affecting the durability of the synthetic resin rotating center portion.

To solve such problems, the thickness of the boss mount member in the rotating member of the impeller main body may be increased, but the impeller main body would increase in size as the rotating center portion becomes larger. Furthermore, if the size of the impeller main body remains the same, then the thickness of the resin portion would be reduced and the load on the rotating center portion would further increase. Due to these facts, it is very difficult to provide an impeller with a limited size.

Lowering the press-fitting load of the boss and the shaft may reduce the effect on the resin portion, but the boss member and the shaft cannot be securely fixed and it becomes difficult to stabilize the attachment to the shaft that drives the impeller main body. Because an impeller for a water pump is used in locations in which changes in the outside temperature environment are stringent, it is difficult for the resin portion to sufficiently bear such conditions if the thickness of the boss member fitting location on the rotating center portion of the impeller main body decreases due to the thermal stress load generated by the difference in the coefficient of linear expansion between the resin impeller main body and the metal boss member.

Thus, for various reasons, the thickness of the resin portion in the rotating center portion of the impeller main body cannot be adjusted to a level at which the resin portion has the same strength as the metal boss member. In other words, in the limited range of the edge periphery in the axial direction of the rotating center portion, it is difficult to use a weakened boss member by reducing the thickness of the boss member, which is the core metal of the impeller main body. Consequently, the resin portion of the rotating center portion must be fashioned in accordance with the boss whose strength is maintained in this manner. It is, however, difficult to increase the thickness of the resin portion under this condition, and the resin portion of the rotating center portion becomes thinner than the boss as a result.

Based on these facts, it is difficult to satisfy the strength and durability conditions of the impeller main body composed of synthetic resin and provided with an inserted metal boss member. An object of the present invention is to provide an impeller for a water pump wherein an impeller main body composed of synthetic resin can be securely fixed to the shaft, and a metal boss member can be insert-fitted into the impeller main body composed of synthetic resin without any adverse effect on the strength of the impeller main body or the strength and durability of the impeller in a stringent operating environment.

As a result of earnest investigation conducted in view of the above situation and aimed at addressing the aforementioned problems, the inventors perfected the present invention upon discovering that the aforementioned problems can be addressed by providing an impeller for a water pump comprising an impeller main body composed of synthetic resin and provided with a vane member formed around a rotating center portion, and comprising a metal boss in which a circular boss member positioned on the forward side of the above-mentioned rotating center portion and provided with a gradually narrowing portion at the axial end thereof, and a periaxial support boss member positioned on the rearward side of the rotating center portion are consecutively formed in the axial direction, and in which an axial support surface is formed between the above-mentioned circular boss member and periaxial support boss member; the metal boss insert-fitted into the above-mentioned rotating center portion; and the periaxial support boss member provided with a detent on the external periphery of the axial end portion thereof, whereby the metal boss is insert-fitted into the rotating center portion of the impeller main body, allowing the thickness in the rotating center portion of the impeller main body to be sufficiently obtained, and the metal boss to be very securely fitted to the impeller main body.

Figure 1A:
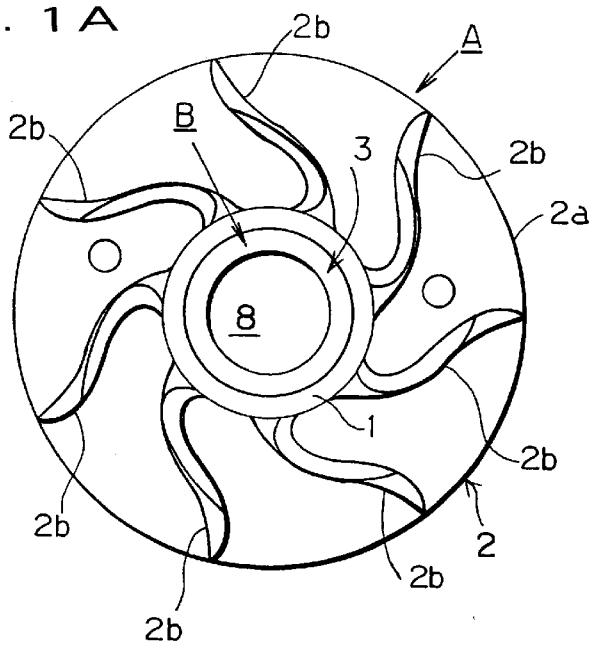
FIG. 1

A is a frontal view of an impeller comprising a metal boss and an impeller main body according to the present invention;

B is a longitudinal profile view of A; and

C is a rear fragmentary view of A.

FIG. 2

A is a perspective view of the first embodiment of a metal boss;

B is a perspective view seen from the periaxial support boss member side of the metal boss;

C is a longitudinal profile view of the metal boss in A; and

D is a magnified cross-sectional view of a metal boss inserted into the rotating center portion.

FIG. 3

A is a perspective view of the second embodiment of a metal boss;

B is a rear view seen from the periaxial support boss member side of the metal boss in A;

C is a perspective view with a portion of the metal boss in A cut away; and

D is a rear view of the impeller main body fitted with a metal boss.

FIG. 4

A is a perspective view of the third embodiment of the metal boss;

B is a rear view seen from the periaxial support boss member side of the metal boss in A; and C is a rear view of the impeller main body fitted with a metal boss.

FIG. 5

A is a perspective view of the fourth embodiment of the metal boss;

B is a longitudinal profile view of the metal boss in A; and

C is a cross-sectional view along the $X_1$-$X_1$ line in B.

FIG. 6

A is a perspective view of the first type of the fifth embodiment of the metal boss;

B is a rear view of the metal boss in A;

C is a perspective view of the second type of the fifth embodiment of metal boss; and D is a rear view of the metal boss in C.

FIG. 7

A is a perspective view of the sixth embodiment of the metal boss;

B is a rear view of the metal boss in A;

C is a cross-sectional view along the $X_2$-$X_2$ line in A; and

D is a cross-sectional view of the gradually narrowing portion not formed on the circular boss.

FIG. 8

A is a perspective view the seventh embodiment of the metal boss;

B is a cross-sectional view along the $X_3$-$X_3$ line in A; and

C is a cross-sectional view of the gradually narrowing portion not formed on the circular boss.

FIG. 9

A cross-sectional view of an arrangement in which the present invention is mounted in a pump casing.

FIG. 10

A is a magnified cross-sectional view of a metal boss having a second type of gradually narrowing portion insert-fitted into the rotating center portion;

B is a magnified cross-sectional view of a metal boss having a third type of gradually narrowing portion insert-fitted into the rotating center portion; and C is a magnified cross-sectional view of a metal boss having a fourth type of gradually narrowing portion insert-fitted into the rotating center portion.

DESCRIPTION OF THE PREFERRED EMBODIMENTS

The embodiments of the present invention are described hereinafter with reference to the diagrams. The present invention comprises an impeller main body A composed of synthetic resin, and a metal boss B. The impeller main body A, as described above, is formed from synthetic resin, and a vane member 2 is formed on the periphery of a rotating center portion 1.

In accordance with the first embodiment of the present invention, the metal boss B is insert-fitted into the rotating center portion 1 of the impeller main body A. The insert is fitted by cast-molding during the molding of the synthetic resin impeller main body A. The vane member 2 is formed by radially disposing a plurality of vane pieces 2*b*, 2*b*, . . . on a discoid vane member support base 2*a*. The above-mentioned vane member support base 2*a* is substantially discoid shaped and the above-mentioned rotating center portion 1 is shaped to gradually expand toward the center of the vane member support base 2*a*. The thickness of the rotating center portion 1 of the above-mentioned impeller main body A is greater toward the rearward side than the forward side.

The metal boss B comprises a circular boss member 3, a periaxial support boss member 4, and an axial support surface 5. The circular boss member 3 is cylindrically shaped, and a gradually narrowing portion 3*a* is formed on a portion thereof. The gradually narrowing portion 3*a* adjusts the thickness of the metal boss B and the resin portion in the rotating center portion 1 of the impeller main body A. Specifically, the gradually narrowing portion is formed at the axial end of the above-mentioned circular boss member 3 and constitutes the portion in which the axial diameter becomes smaller. The above-mentioned gradually narrowing portion 3*a* and a cylindrical external peripheral surface 3*b* are formed on the entire surface of the above-mentioned circular boss member 3. The cylindrical external peripheral surface 3*b* is a cylindrical region with a parallel planar shape in the axial direction. By providing the gradually narrowing portion surface 3*a*, the surface (hereinafter called 'bearing surface') at the axial leading edge of the metal boss B positioned on the end face of the rotating center portion 1 can be minimized, and the desired strength of the rotating center portion 1 can be obtained because the resin portion can be made thicker. Also, by providing the cylindrical external peripheral surface 3*b* smoothly linking the gradually narrowing portion 3*a* of the circular boss member 3 and the stepped portion, the concentration of stress on the stepped portion is relaxed and lower rigidity is prevented. It should be noted that the above-mentioned cylindrical external peripheral surface 3*b* has a planar shape parallel to the axial direction, but is not limited to the above-mentioned planar shape and may take a form capable of providing smooth linkage from the gradually narrowing portion 3*a* to the stepped portion.

The gradually narrowing portion 3*a* may have a variety of shapes, of which the first type is a tapered external peripheral surface $3a_1$ configured as a truncated cone whose diameter gradually decreases from the area near axial end of the above-mentioned circular boss member 3 toward the outer direction, as shown in FIGS. 1–6 and the like. That is, the tapering in the gradually narrowing portion 3*a* is formed as a linear slope along the axial direction of the circular boss member 3. The gradually narrowing portion 3*a* of this circular boss member 3 is not limited to a fixed angle and may assume any appropriately selected angle. Selecting an angle that follows or approximates the slope of the rotating center portion 1 makes it possible to provide adequate thickness to the leading edge portion, which is an area in which the resin water pump in the rotating center portion 1 tends to become thinner. That is, the gradually narrowing portion 3*a* is formed at a slope to achieve the required thickness for the metal boss B and the synthetic resin portion in the rotating center portion 1 of the impeller main body A.

Figure 10A:
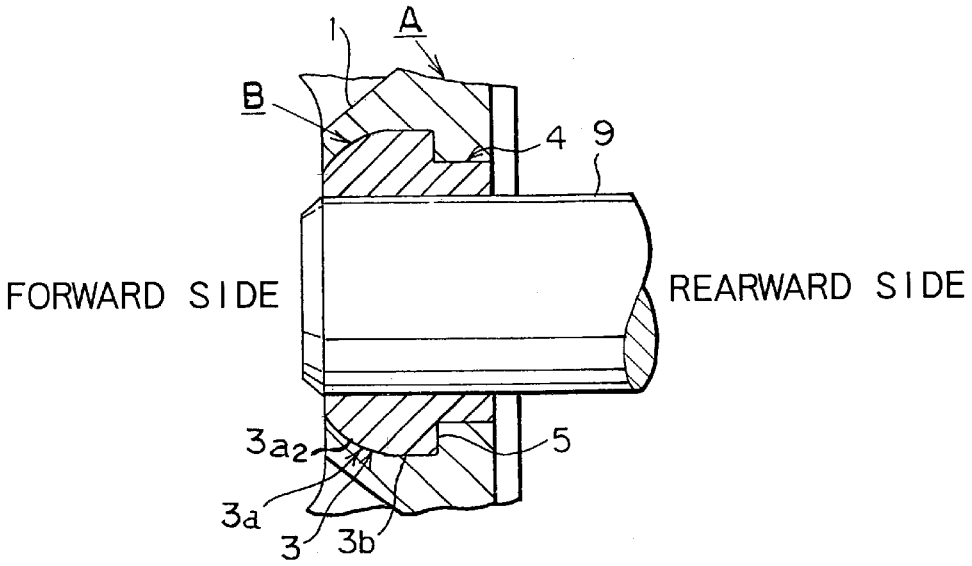

The second type of the above-mentioned gradually narrowing portion 3*a* has an expanded external peripheral surface $\mathbf{3}a_2$, the cross section thereof substantially arcuate along the axial direction of the circular boss member 3, as shown in FIG. 10A. The expanded external peripheral surface $\mathbf{3}a_2$ is a location formed such that the external periphery expands outward toward the outside radial direction. When an expanded external peripheral surface $\mathbf{3}a_2$ is adopted as the second type of gradually narrowing portion 3*a*, the circular boss member 3 facing the rotating center portion 1 of the impeller main body A can be made much thicker, and the desired strength can be obtained in the area facing the impeller main body A.

Figure 10B:
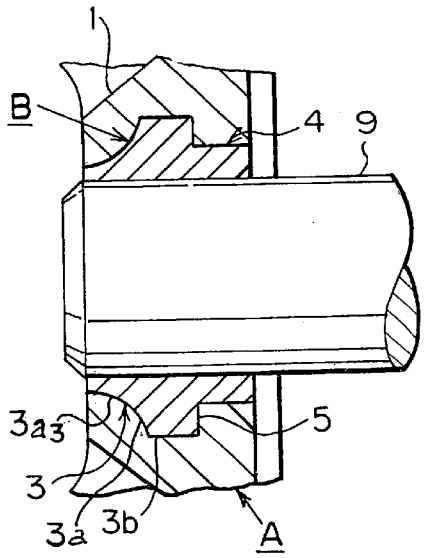

The third type of the above-mentioned gradually narrowing portion 3*a* has a concave external peripheral surface $\mathbf{3}a_3$, the shape thereof being concave in the internal radial direction along the axial direction of the circular boss member 3, the cross section thereof formed with a concave arcuate shape along the axial direction, as shown in FIG. 10B. In a combination of the circular boss member 3 and the rotating center portion 1 of the impeller main body A, the concave external peripheral surface $\mathbf{3}a_3$ as the third type of gradually narrowing portion 3*a* can be provided with considerable thickness in the area facing the rotating center portion 1 and can be kept strong in the area facing the impeller main body A.

Figure 10C:
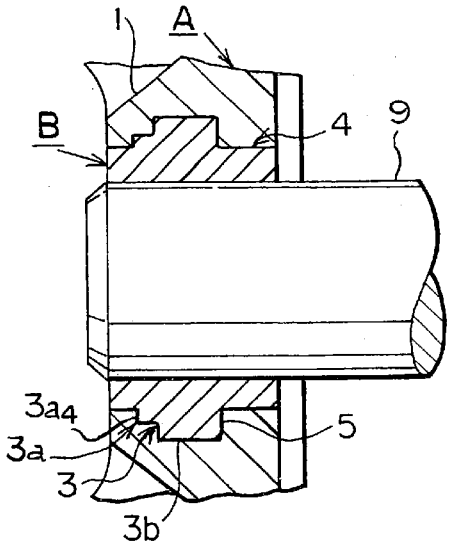

The fourth type of the above-mentioned gradually narrowing portion 3*a*, as shown in FIG. 10C, has a stepped external peripheral surface $\mathbf{3}a_4$ such that the axle diameter narrows in steps. The stepped external peripheral surface $\mathbf{3}a_4$ is formed such that the external peripheral surface thereof changes in stepwise fashion. In the stepped external peripheral surface $\mathbf{3}a_4$ as the fourth type of gradually narrowing portion, the assembly integrated with the metal boss B on the side facing the impeller main body A is reinforced and the desired strength can be obtained by improving the bite of the synthetic resin in the rotating center portion 1 of the impeller main body A.

The circular boss member 3 is adjacent to the periaxial support boss member 4 toward the inside in the axial direction. The outside diameter of the circular boss member 3 is formed larger than the radial dimension of the periaxial support boss member 4, and the stepped portion between the circular boss member 3 and the periaxial support boss member 4 serves as an axial support surface 5 orthogonal (or substantially orthogonal) to the axial direction. The axial support surface 5 is a surface for fixing the rotating center portion 1 in the axial direction with the metal boss B inserted into the rotating center portion 1.

The periaxial support boss member 4 is a location for fixing the metal boss B in the rotating direction to the impeller main body A. A detent member 4*a* is disposed on the external periphery of the periaxial support boss member 4, or on the axial end and external periphery of the periaxial support boss member 4. A variety of shapes can be adopted for the detent member 4*a*. The first type is a detent member 4*a* provided to a polygonal surface $\mathbf{4}a_1$, which is obtained by fashioning the periaxial support boss member 4 into a polygonal external shape. The polygonal surface $\mathbf{4}a_1$ has a hexagonal shape, as shown in detail in FIGS. 2A and 2B. Configuring the polygonal surface $\mathbf{4}a_1$ as a hexagon allows the outside diameter of the periaxial support boss member 4 to be reduced in comparison with the boss hole 8 of the metal boss B. A square shape or a polygonal shape with six or more sides can be sited as other possible shapes of the polygonal surface $\mathbf{4}a_1$.

Figure 1B:
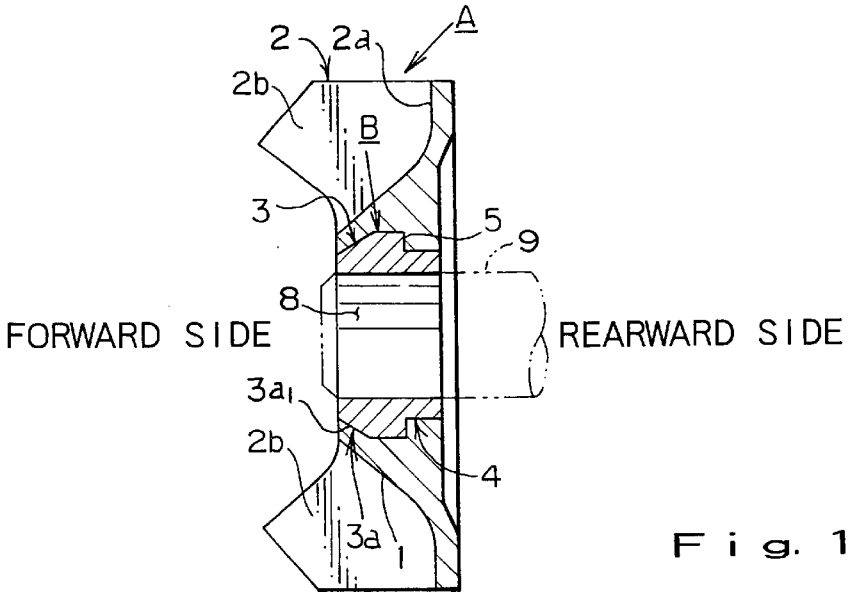
Figure 1C:
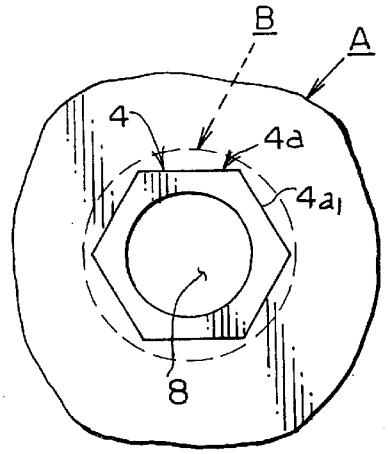
Figure 2A:
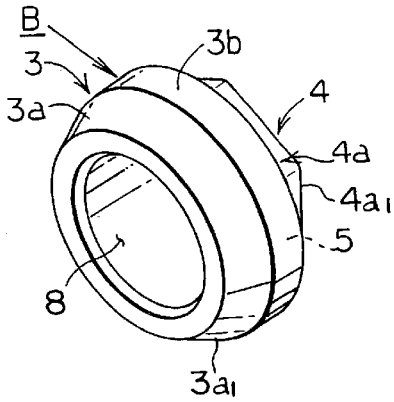
Figure 2B:
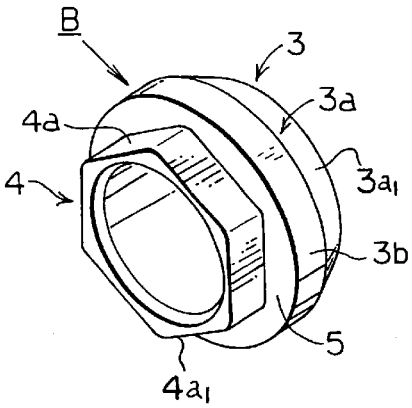
Figure 2C:
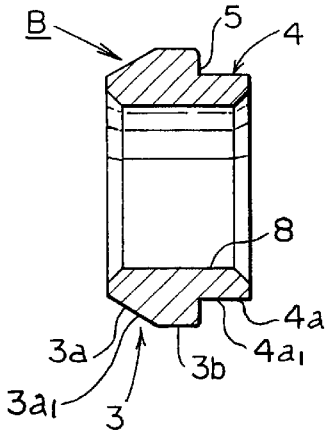
Figure 2D:
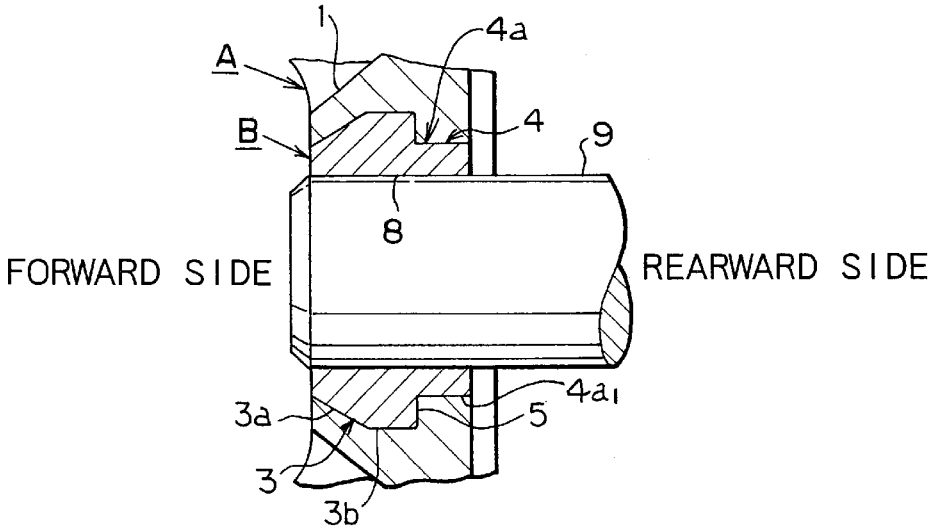
Figure 9:
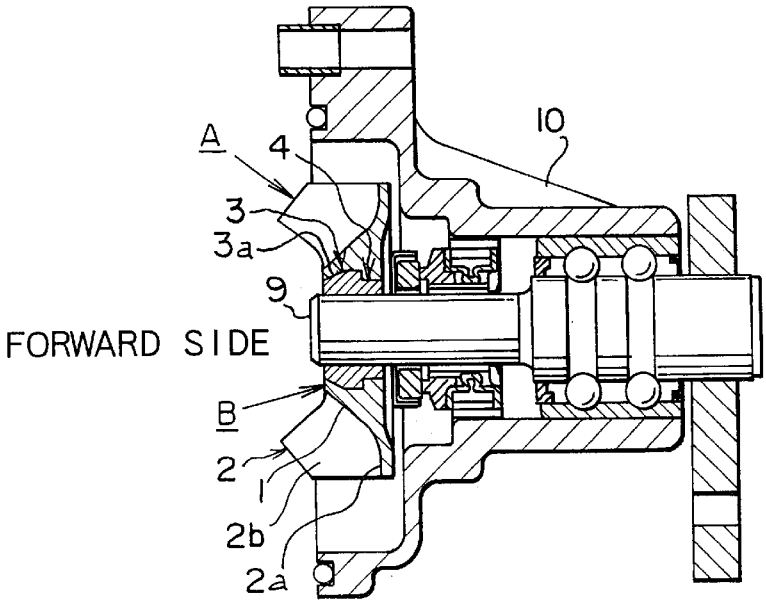

The stepped portion formed between the polygonal surface $\mathbf{4}a_1$ and the above-mentioned circular boss member 3 serves as the axial support surface 5. The area facing the circular boss member 3 is positioned on the forward side of the rotating center portion 1 of the above-mentioned impeller main body A; the axial support surface 5 is positioned in a substantially central location in the axial direction of the above-mentioned rotating center portion 1; and the area facing the periaxial support boss member 4 is positioned on the rearward side of the rotating center portion 1 of the impeller main body A so as to be insert-fitted into the impeller main body A, as shown in FIGS. 1B, 2B, 9, and the like. Furthermore, the above-mentioned detent member 4*a* is insert-fitted such that a portion thereof protrudes to the edge position further on the rearward side of the impeller main body A as shown in FIGS. 1B, 1C, and the like.

With the above-mentioned structure, the stress load does not affect the vane member 2 and the rotating center portion 1 formed with synthetic resin, and the strength and durability of the product do not decrease when the impeller main body A is press-fitted into the shaft 9. The shaft 9 and the metal boss B of the impeller is press-fitted by the application of a press-fitting load in the axial direction from the impeller main body A side. In such a case, a radial stress load is generated in the metal boss B by the press-fitting of the shaft 9, and although the stress is transferred to the rotating center portion 1 from the metal boss B insert-fitted into the rotating center portion 1, the above-mentioned periaxial support boss member 4 can sufficiently withstand the high speed rotations from the metal boss B because this support boss member is located in a relatively thick portion of the rotating center portion 1 at an intersection with the above-mentioned vane member support base 2*a*. (Refer to FIGS. 1B and 2D).

In an arrangement in which a tapered external peripheral surface $\mathbf{3}a_1$ is formed on the circular boss member 3 of the above-mentioned metal boss B, there is no increase in the thickness of the end face of rotating center portion 1 of the impeller main body A, and the end face thereof can be appropriately used as a bearing surface. Based on these facts, the rotating center portion 1 can be provided with the desired strength because the bearing surface on the end face of the rotating center portion 1 can be minimized and the resin portion on the end face of the rotating center portion 1 can be can be made rather thick. Moreover, the axial and radial strength of the rotating center portion 1 can be increased, the deformation under the stress load induced by press-fitting can be reduced, and the effect on the rotating center portion 1 composed of synthetic resin can also be reduced as a result of the fact that the rotating center portion 1 is configured as a cone whose diameter expands gradually such that the thickness thereof increases in the radial direction toward the vane member support base 2*a* of the vane member 2.

In addition, an impeller for a water pump in an internal combustion engine used under stringent environmental conditions can bear a thermal stress load generated by variations in the outside temperature environment because the balance of thickness between the metal boss B and the rotating center portion 1 can be optimized. Based on these facts, the impeller main body A can be made stronger and more durable without any increase in size, and the synthetic resin impeller main body A and the metal boss B can be prevented from rotating or slipping off in the axial direction.

Figure 3A:
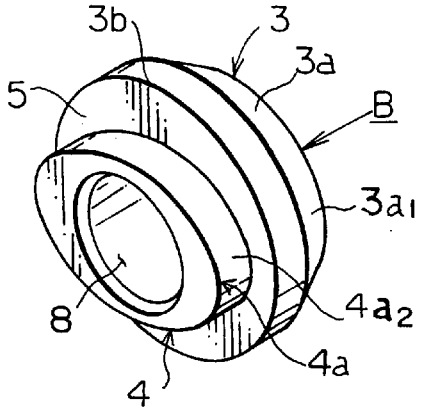
Figure 3B:
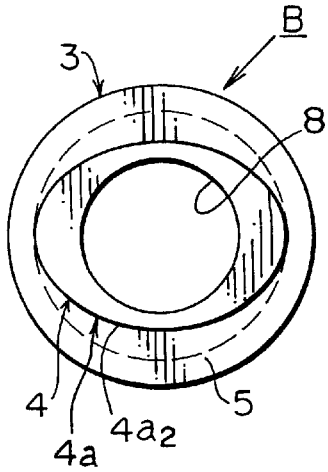
Figure 3C:
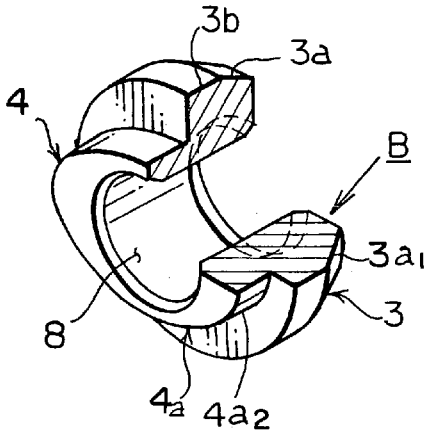
Figure 3D:
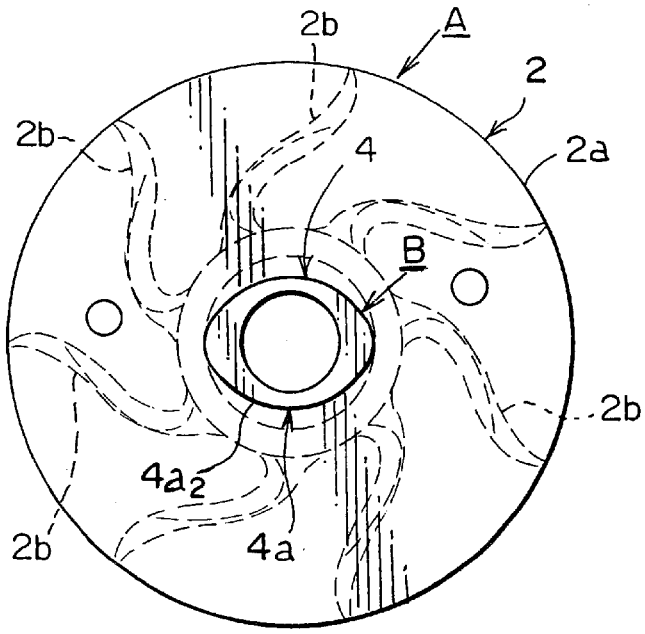
Figure 4A:
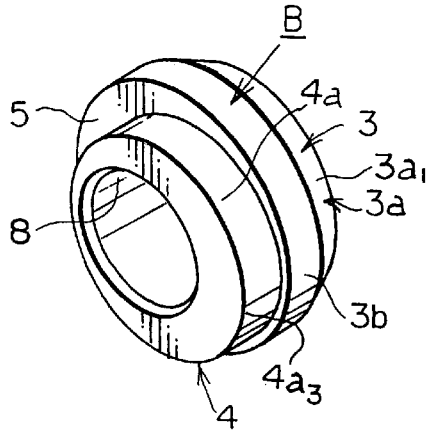
Figure 4B:
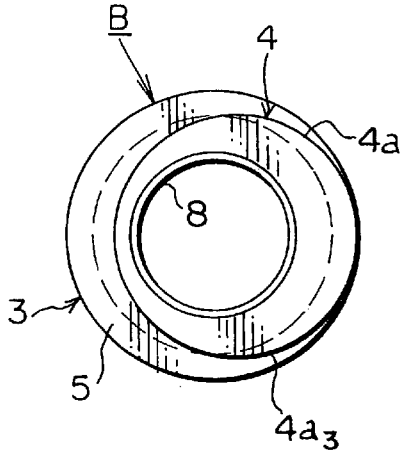
Figure 4C:
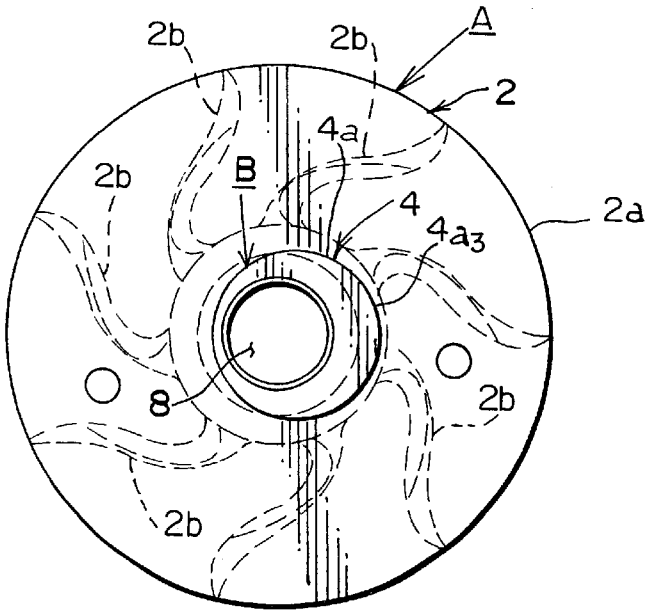

According to a second embodiment of the metal boss B, the detent member 4*a* thereof has an elliptic surface $4a_2$ as the external peripheral surface of the above-mentioned periaxial support boss member 4 (Refer to FIGS. 3A, 3B, and 3C). The external shape of the elliptic surface $4a_2$ is elliptical or substantially elliptical, and includes circular shapes other than a true circle. The periaxial support boss member 4 with an elliptical surface $4a_2$ is balanced with the inside diameter of the boss hole 8.

Figure 5A:
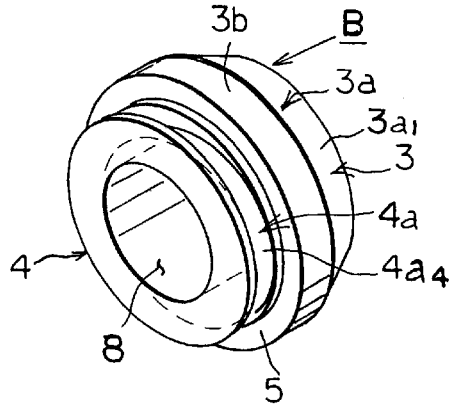
Figure 5B:
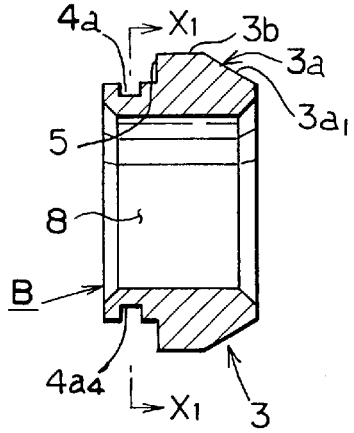
Figure 5C:
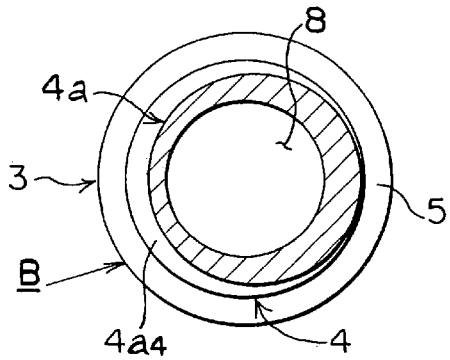
Figure 6A:
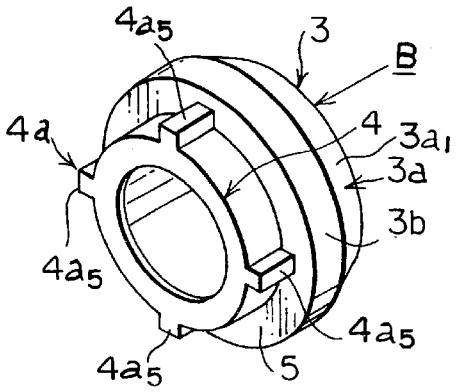
Figure 6B:
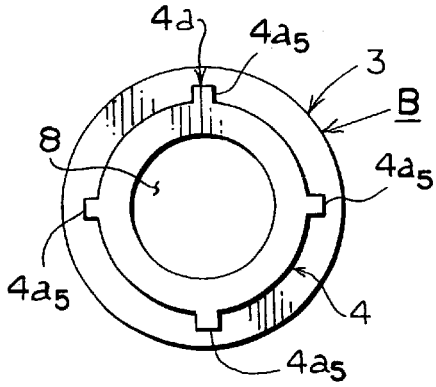
Figure 6C:
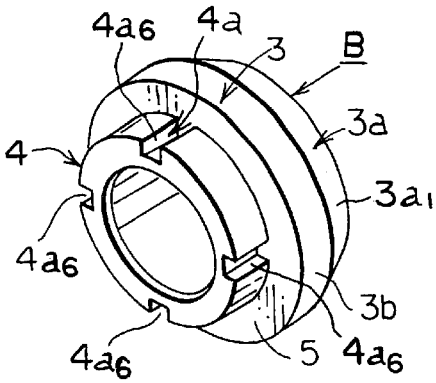
Figure 6D:
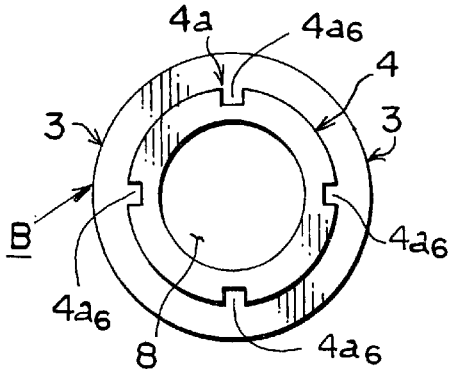

According to a third embodiment of the metal boss B, the above-mentioned detent member 4*a* is provided with a circular shape for the external peripheral surface of the above-mentioned periaxial support boss member 4, forming an eccentric circular surface $4a_3$ whose axle center is eccentric in relation to the axle center of the above-mentioned circular boss member 3. That is, the axle center of the above-mentioned circular boss member 3 and the axle center of the detent member 4*a* are offset from each other (Refer to FIGS. 4A, 4B, and 4C). In this third embodiment, the axle centers of each of the holes (boss hole 8) match the axle centers of the above-mentioned circular boss member 3 and the periaxial support boss member 4. Moreover, according to a forth embodiment, a cylindrical periaxial support boss member 4 having an axle center matching the axle center of the above-mentioned circular boss member 3 forms the above-mentioned detent member 4*a*, and an eccentric circular groove $4a_4$ eccentric to the axle center of the above-mentioned circular boss member 3 is formed on the external periphery of the periaxial support boss member 4 (Refer to FIGS. 5A and 5B). The eccentric circular groove $4a_4$, as shown in FIG. 5C, is also eccentric to the boss hole 8.

According to the first type of a fifth embodiment of the metal boss B, protrusions $4a_5$, $4a_5$, . . . formed at substantially equal intervals on the periphery of the cylindrical periaxial support boss member 4 serve as the above-mentioned detent 4*a*. The protrusions $4a_5$ are configured so as to protrude in the radial direction from the external peripheral surface of the cylinder, the detent member 4*a* is insert-fitted into the rotating center portion 1, and the above-mentioned protrusions $4a_5$, $4a_5$, . . . bite into the resin, thereby serving as a detent. A single protrusion $4a_5$ may be used, or a plurality of such protrusions may be used (Refer to FIGS. 6A and 6B). In accordance with the second type of the fifth embodiment of the metal boss B, indentations $4a_6$, $4a_6$, . . . formed at substantially equal intervals on the periphery of the cylindrical periaxial support boss member 4 serve as the above-mentioned detent 4*a*. The indentations $4a_6$ are configured so as to be indented toward the radial direction center from the external peripheral surface of the cylinder, the detent member 4*a* is insert-fitted into the rotating center portion 1, and resin enters into the above-mentioned indentations $4a_6$, $4a_6$, . . . thereby serving as a detent. A single indentation $4a_6$ may be used, or a plurality of such indentations may be used (Refer to FIGS. 6C and 6D).

Figure 7A:
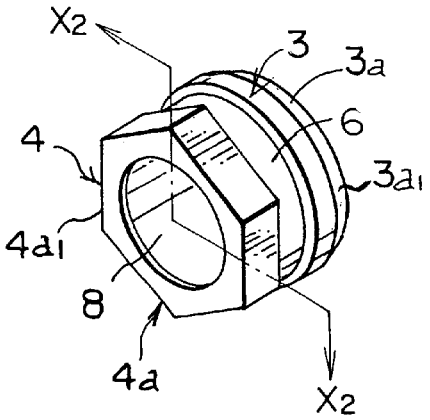
Figure 7B:
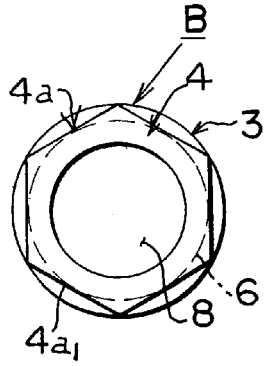
Figure 7C:
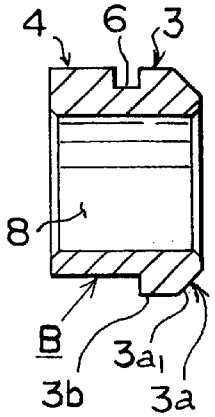
Figure 7D:
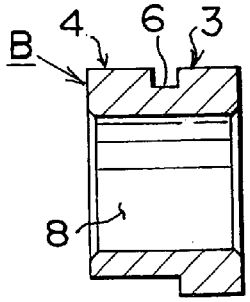

According to a sixth embodiment of the above-mentioned metal boss B, the above-mentioned detent 4*a* has a slip-off stop groove 6 formed between the polygonal surface $4a_1$ and the circular boss member 3, as shown in FIGS. 7A, 7B, 7C and 7D. The presence of the slip-off stop groove 6 can provide the metal boss B with the desired thickness in the central direction of the rotating center portion 1 belonging to the impeller main body A. Furthermore, positioning this component in the area near the rearward side of the vane member 2 allows a thick resin portion to be formed at the location in which the components are insert-fitted into the rotating center portion 1 in the area occupied by the slip-off stop groove 6, and the desired strength can easily be obtained thereby. Furthermore, thickness can be easily balanced without enlarging the end face of the rotating center portion 1 on the side facing the vane member 2. Moreover, even if the resin portion of the end face of the rotating center portion 1 is thin, it is still possible to prevent stress from being concentrated due to the stress load in the resin portion. In this embodiment, the gradually narrowing portion 3*a* is formed on the above-mentioned circular boss member 3, as shown in FIGS. 7A and 7C, and the gradually narrowing portion 3*a* may not be formed on the above-mentioned circular boss member 3, as shown in FIG. 7D.

Figure 8A:
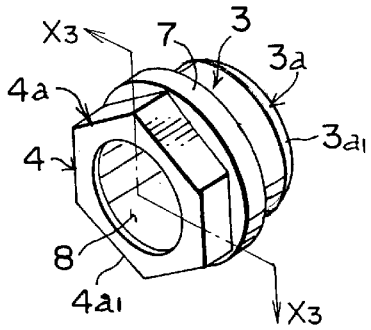
Figure 8B:
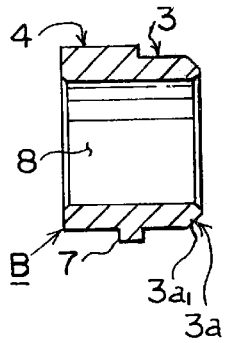
Figure 8C:
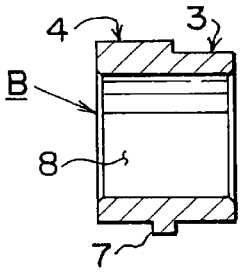

According to a seventh embodiment of the above-mentioned metal boss B, a discoid flange member 7 is formed as a slip-off stop in the axial direction in the above-mentioned metal boss B, as shown in FIGS. 8A and 8B. In this embodiment, positioning the discoid flange member 7 to the rearward side of the vane member 2 allows the resin member of rotating center portion 1 to be readily provided with the desired strength, and hence the vane member 2 to be readily provided with the desired resin strength. Furthermore, because the axially oriented slip-off stop discoid flange member 7 is positioned at the location in which the thickness is expanding in the radial direction in the rotating center portion 1, it is possible to prevent the stress induced by the stress load from being concentrated. In this embodiment as well, the above-mentioned gradually narrowing portion 3*a* is formed on the above-mentioned circular boss member 3, as shown in FIGS. 8A and 8B, and the above-mentioned gradually narrowing portion 3*a* may not be formed on the above-mentioned circular boss member 3, as shown in FIG. 8C. It should be noted that FIG. 9 shows the impeller of the present invention fitted to the shaft 9 of the pump casing 10.

The invention is effective in providing sufficient thickness to the rotating center portion 1 on the impeller main body A side, and allows to metal boss B to be very securely fitted into the impeller main body A in an impeller for a water pump comprising an impeller main body A composed of synthetic resin and provided with a vane member 2 formed around a rotating center portion 1, and comprising a metal boss B in which a circular boss member 3 positioned on the forward side of the rotating center portion 1 and provided with a gradually narrowing portion 3*a* at the axial end thereof, and a periaxial support boss member 4 positioned on the rearward side of the rotating center portion 1 are consecutively formed in the axial direction, and in which an axial support surface 5 is formed between the circular boss member 3 and periaxial support boss member 4, with the metal boss B insert-fitted into di: rotating center portion 1.

The above-mentioned effects will be described in greater detail below. The circular boss member 3 and the periaxial support boss member 4 are consecutively formed in the axial direction, and an axial support surface 5 is formed between the circular boss member 3 and the periaxial support boss member 4 in the metal boss B. The periaxial support boss member 4 serves to fix the impeller main body A in the peripheral direction, the axial support surface 5 serves to fix the impeller main body A in the axial direction, and the above-mentioned periaxial support boss member 4 is inserted at a location in which the radially oriented resin portion of the impeller main body A is provided with considerable thickness, whereby the system can be securely fixed in the axial direction and prevented from rotating without adversely affecting the strength of the resin portion. Furthermore, the gradually narrowing portion 3*a* is formed on the axial end of the above-mentioned circular boss member 3, making it possible to increase the thickness of the rotating center portion 1 in proportion to the reduction in the thickness of the gradually narrowing portion 3*a* at the location in which the gradually narrowing portion 3*a* of the circular boss member 3 is fitted into the rotating center portion 1 of the above-mentioned impeller main body A, whereby the rotating center portion 1 of the above-mentioned impeller main body A can be made stronger and a durable structure can be obtained.

The invention is also capable of providing an exceptionally strong, durable impeller for a water pump, wherein this impeller for a water pump comprises an impeller main body A composed of synthetic resin and provided with a vane member 2 formed around a rotating center portion 1, and also comprises a metal boss B in which a circular boss member 3 positioned on the forward side of the rotating center portion 1, and a periaxial support boss member 4 positioned on the rearward side of the rotating center portion 1 and provided with a detent 4*a* on the external periphery of the axial end portion thereof are consecutively formed in the axial direction, and in which an axial support surface $ is formed between the circular boss member 3 and periaxial support 4, with the metal boss B insert-fitted into the rotating center portion 1.

The above-mentioned effects will be described in greater detail below. The detent member 4*a* of the periaxial support boss member 4 is fixed in a circumferential position on the impeller main body A with respect to the rotating center portion 1, and is intended to securely fit the metal boss B on the impeller main body A. Rotation-induced stress particularly concentrates on the detent member 4*a* of the periaxial support boss member 4 without regard to the shape thereof. Thus, the periaxial support boss member 4 is positioned in the area with a relatively thick resin in the rotating center portion 1 of the impeller main body A, and because the detent member 4*a* is disposed in thickest rearward position of the above-mentioned rotating center portion 1 and around the outside of the axial end of the above-mentioned support boss 4, the metal boss B is securely fixed to the impeller main body A and the impeller main body A is provided with adequate rigidity.

The invention as described above allows the thinnest forward side of the rotating center portion 1 of the impeller main body A to be rendered sufficiently rigid by providing the above-mentioned gradually narrowing portion 3*a*. It can also be concluded that sufficient rigidity can be maintained on the rearward side by disposing the periaxial support boss member 4 and the axial support surface 5 (which receive stress from rotation) on the relatively thin rearward side of the rotating center portion 1, and by disposing the above-mentioned detent member 4*a* on the thickest portion. In other words, it can be said that both inventions allow the end portions of the rotating center portion 1 in the impeller main body A to be kept at an the desired rigidity level.

The invention further allows the Stress concentrated on the stepped portion to be reduced and lower rigidity to be prevented by means of the cylindrical external peripheral surface 3*b* smoothly linking the gradually narrowing portion 3*a* of the circular boss member 3 and the stepped portion in an impeller for a water pump according to claim 1, in which the outside diameter of the circular boss member 3 of the metal boss B is formed larger than the radial dimension of the periaxial support boss member 4, the axial support surface 5 is formed on the stepped section between the circular boss member 3 and the periaxial support boss member 4, and a cylindrical external peripheral surface 3*b* is provided for linking the gradually narrowing portion 3*a* and the stepped section.

The invention further provides sufficient strength to the rotating center portion 1 by allowing the resin of the rotating center portion 1 to be Conned as a thick component, and satisfies mutually contradictory requirements in a limited size without increasing the size of the impeller main body A by providing an impeller for a water pump according to claim 1, in which the gradually narrowing portion 3*a* comprises a tapered external peripheral surface 3*a*1 whose outside diameter decreases outwardly on the side facing the axial end of die circular boss member 3.

The invention further configures the expanding external peripheral surface 3*a*2 of the gradually narrowing portion 3*a* as a substantially outwardly expanding shape, makes it possible to form the circular boss member 3 as a thick component, and increases the strength of the rotating center portion 1 of the impeller main body A by providing an impeller for a water pump according to claim 1, wherein the gradually narrowing portion 3*a* comprises an expanded external peripheral surface 3*a*2 whose cross section in the axial direction has a substantially arcuate shape.

The invention provides a gradually narrowing portion 3*a* having a concave external peripheral surface 3*a*3 with a concave shape in the axial direction, whereby the rotating center portion 1 of the above-mentioned impeller main body A can be made even thicker and the rotating center portion 1 location of the impeller main body A can be provided with sufficient mechanical strength in an impeller for a water pump according to claim 1, wherein the gradually narrowing portion 3*a* comprises a concave external peripheral surface 3*a*3 whose cross section in the axial direction has a substantially concave arcuate shape.

The invention further improves the bite of the resin of the impeller main body A on the side facing the rotating center portion 1, strengthens the integration with the boss on the side of the impeller main body A, and provides the desired strength in an impeller for a water pump according to claim 1, wherein the gradually narrowing portion 3*a* comprises a stepped external peripheral surface 3*a*4 whose the cross section in the axial direction has a substantially stepped shape.

The invention further provides maximum efficiency in terms of preventing rotation in an impeller for a water pump according to claim 2, wherein the detent member 4*a* is formed such that the external perimeter thereof is Conned by a polygonal surface 4*a*1.

The invention further provides a periaxial support boss member 4 with good manufacturing and machining characteristics in an impeller for a water pump according to claim 2, wherein the detent member 4*a* is formed as an elliptic surface 4*a*2.

The invention further provides a detent member 4*a* with a particularly simple surface and improved manufacturing characteristics in an impeller for a water pump according to claim 2, wherein the detent member 4*a* is formed as an eccentric circular surface 4*a*3 whose circular external peripheral surface is eccentric to the axle center of the circular boss member 3.

The invention further allows a metal boss B to be securely insert-fitted to the rotating center portion 1 in the direction of rotation as well as in the axial direction by providing an impeller for a water pump according to claim 2, wherein the detent member 4*a* is formed as an eccentric circular groove 4*a*4 eccentric to the axle center of the circular boss member 3.

The invention further allows the above-mentioned protrusions 4*a*5, 4*a*5, . . . to stop rotation with extremely high efficiency by biting into the resin portion of the rotating center portion 1 in an impeller for a water pump according to claim 2, wherein the protrusions 4*a*5, 4*a*5, . . . are formed on the detent member 4*a*.

The invention further allows the resin of the rotating center portion 1 to enter into the indentations 4*a*6, 4*a*6, . . . and to function as a highly efficient detent member 4*a* in a state in which the boss is inserted into the rotating center portion in an impeller for a water pump according to claim 2, wherein the indentations 4*a*6, 4*a*6, . . . are fanned on the detent member 4*a*.

TABLE OF REFERENCE NUMERALS

IMPELLER MAIN BODY A, METAL BOSS B, ROTATING CENTER PORTION 1, VANE MEMBER 2, VANE MEMBER SUPPORT BASE 2*a*, VANE PIECE 2*b*, CIRCULAR BOSS MEMBER 3, GRADUALLY NARROWING PORTION 3*a*, TAPERED EXTERNAL PERIPHERAL SURFACE $3a_1$, EXPANDED EXTERNAL PERIPHERAL SURFACE $3a_2$, CONCAVE EXTERNAL PERIPHERAL SURFACE $3a_3$, STEPPED EXTERNAL PERIPHERAL SURFACE $3a_4$, CYLINDRICAL EXTERNAL PERIPHERAL SURFACE 3*b*, PERIAXIAL SUPPORT BOSS MEMBER 4, DETENT MEMBER 4*a*, POLYGONAL SURFACE $4a_1$, ELLIPTIC SURFACE $4a_2$, ECCENTRIC CIRCULAR SURFACE $4a_3$, ECCENTRIC CIRCULAR GROOVE $4a_4$, PROTRUSION $4a_5$, INDENTATION $4a_6$, AXIAL SUPPORT SURFACE 5, DISCOID FLANGE MEMBER 7, BOSS HOLE 8, SHAFT 9, PUMP CASING 10.

What is claimed is:

1. An impeller for a water pump comprising: an impeller main body composed of a synthetic resin and having a vane member formed around a rotating center portion; and a metal boss in which a gradually narrowing portion positioned on the forward side of said rotating center portion, funned in a location on the axial end portion, and having a gradually decreasing axial diameter, a circular boss member whose entire outer peripheral surface is funned by said gradually narrowing portion and a cylindrical outer peripheral surface, and a periaxial support boss member positioned on the rearward side of the rotating center portion and provided with a detent on the outer periphery of the axial end portion thereof are formed consecutively in the axial direction, and in which an axial support surface is formed between said circular boss member and periaxial support boss member, said metal boss being insert-fitted into said rotating center portion.

2. The impeller for a water pump according to claim 1, wherein said circular boss member is constituted such that the gradually narrowing portion, which gradually decreases in diameter rectilinearly outward from the axial end portion of said circular boss member, and said cylindrical outer peripheral surface consecutively form the entire outer peripheral surface thereof.

3. The impeller for a water pump according to claim 1, wherein the outside diameter of the circular boss member of said metal boss is formed larger than the radial dimension of said periaxial support boss member, said axial support surface is formed on the stepped section between the circular boss member and said periaxial Support boss member, and a cylindrical external peripheral surface is provided for linking said gradually narrowing portion and said stepped section.

4. The impeller for a water pump according to claim 1, wherein said gradually narrowing portion comprises an expanded external peripheral surface, whose cross section in the axial direction has a substantially arcuate shape.

5. The impeller for a water pump according to claim 1, wherein gradually narrowing peripheral surface, whose cross section in the axial direction has a substantially concave arcuate shape.

6. The impeller for a water pump according to claim 1, wherein said gradually narrowing portion comprises a stepped external peripheral surface whose cross section in the axial direction has a substantially stepped shape.

7. The impeller for a water pump according to claim 1, wherein said detent member is formed such that the external perimeter thereof is formed by a polygonal surface.

8. The impeller for a water pump according to claim 1, wherein said detent member is formed as an elliptic surface $4a_2$.

9. The impeller for a water pump according to claim 1, wherein said detent member is formed as an eccentric circular surface whose circular external peripheral surface is eccentric to the axle center of the circular boss member.

10. The impeller for a water pump according to claim 1, wherein said detent member is funned as an eccentric circular groove eccentric to the axle center of said circular boss member.

11. The impeller furs water pinup according to claim 1, wherein are formed on the outer periphery of said detent member.

12. The impeller a water pump according to claim 1, wherein indentations are farmed on the outer periphery of said detent member.

13. An impeller for a water pump, said impeller comprising:

an impeller main body having a vane member formed around a hollow central portion; and a hub insert fined into the hollow central portion of the impeller main body and having an inner axial hole, said insert including, in an axial direction thereof, a front portion and a rear portion contiguously extending rearwardly from said front portion to define a shoulder at a rear end face of said front portion;

wherein an entire outer surface of said front portion defines a circle in any cross section taken perpendicular to the axial direction; and an outer diameter of said front portion decreases toward a front end face thereof.

14. The impeller of claim 13, wherein said front portion includes a cylindrical portion extending from the shoulder forwardly, and a tapering portion extending from the cylindrical portion forwardly, said tapering portion having an outer diameter that decreases toward said front end face.

15. The impeller of claim 13, wherein the outer surface of the front portion includes a truncated conical surface ending at said front end face.

16. The impeller of claim 13, wherein the front portion includes a tapering portion having an outer diameter that gradually decreases toward said front end face, said tapering portion defining a curve in a crass section taken along the axial direction of said hub insert.

17. The impeller of claim 13, wherein the front portion includes a tapering portion having an outer diameter that decreases toward said front end face, said tapering portion having a stepwise cross section taken along the axial direction.

18. The impeller of claim 13, wherein an outer surface of the rear portion defines an ellipse m a cross section taken perpendicular to the axial direction.

19. The impeller of claim 13, wherein an outer surface of the rear portion defines a circle in a cross section taken perpendicular to the axial direction, and said circle and the inner axial hole are eccentric.

20. The impeller of claim 13, wherein the rear portion has a circular groove eccentrically disposed with respect to the inner axial hole.

21. The impeller of claim 13, wherein an outer surface of said rear portion has protrusions or indentations.

* * * * *